US005287972A

United States Patent [19]

Saathoff

[11] Patent Number: 5,287,972

[45] Date of Patent: Feb. 22, 1994

[54] GUN RACK

[76] Inventor: Ralph D. Saathoff, 2305 Trailridge Dr., Plano, Tex. 75074

[21] Appl. No.: 817,287

[22] Filed: Jan. 6, 1992

[51] Int. Cl.[5] ..... A47F 7/00

[52] U.S. Cl. ..... 211/64; 211/4; 248/552; 70/58

[58] Field of Search ..... 211/64, 4, 7, 8, 9, 211/60; 248/551-553; 70/58, 57, 62, 14, 94; 292/338, 339

[56] References Cited

U.S. PATENT DOCUMENTS

| | | | |
|---|---|---|---|
| 2,616,566 | 10/1951 | Levy . | |
| 2,710,100 | 12/1952 | Vermillion . | |
| 2,958,423 | 5/1958 | Caloiero et al. . | |
| 3,180,494 | 10/1963 | Levy . | |
| 4,113,107 | 9/1978 | Jaeger . | |
| 4,139,100 | 2/1979 | Reed . | |
| 4,182,453 | 1/1980 | Worswick | 211/64 X |
| 4,596,334 | 6/1986 | Daulton . | |
| 4,624,372 | 11/1986 | Brolin . | |
| 4,696,405 | 2/1987 | Waring . | |
| 4,777,809 | 10/1988 | Wiggins | 70/58 X |

FOREIGN PATENT DOCUMENTS

| | | | |
|---|---|---|---|
| 3641425 | 9/1988 | Fed. Rep. of Germany | 211/64 |

*Primary Examiner*—Alvin C. Chin-Shue
*Attorney, Agent, or Firm*—Daniel V. Thompson

[57] ABSTRACT

A gun rack is provided for storing and displaying a plurality of firearms. The gun rack includes a substantially rectangular frame having a plurality of laterally spaced uprights and a plurality of vertically spaced crossbars spanning between the uprights. The frame is attachable to a vertical mounting surface, such as a wall. A relatively flat panel member is adapted for attachment to the frame, to substantially cover the frame and prevent the frame from being detached from the mounting surface. The frame further includes a plurality of first support pins spaced vertically along one of the uprights and a plurality of second support pins spaced vertically along the other upright. The support pins are adapted to support the plurality of guns in a substantially horizontal position. First and second elongated locking bars are provided for being secured to the frame, to prevent removal of the guns mounted on the frame. First and second elongated beams are mounted adjacent the respective first and second bars. The first beam has a first U-shaped channel positionable in facing relationship with the frame for receiving respective end portions of the first support pins. The second beam has a U-shaped channel positionable in facing relationship with the frame for receiving respective end portions of the second support pins. A plurality of locking devices are provided for locking the elongated bars in locking engagement with the frame.

13 Claims, 6 Drawing Sheets

GUN RACK

FIELD OF INVENTION

This invention relates generally to racks for storing and displaying firearms in and particular to a gun rack with improved features for securing the guns stored therein against theft and unauthorized use.

BACKGROUND OF THE INVENTION

Firearms, including rifles, shot guns and handguns, are often stored and displayed on a rack. In some cases, the rack is included as part of a gun storage cabinet. In other cases, the rack is attached directly to a wall or other vertical support surface. Guns are expensive and, of course, can be dangerous when used improperly. Therefore, it is advisable that guns be secured, when not in use, against theft and removal by unauthorized persons, such as children.

DESCRIPTION OF THE PRIOR ART

According to prior practice, gun racks typically include first and second laterally spaced uprights, each of which has a plurality of support members spaced along the corresponding upright for supporting a plurality of guns. A locking device is typically used to secure the guns in the rack. The rack is usually attached to a wall by mounting screws.

On type of gun rack, as shown in U.S. Pat. No. 4,139,100, features a vertical row of C-clamp gun barrel supports on one upright and a vertical row of pins projecting from the other upright. Each pin is extendable through an opening in the trigger guard of a gun mounted thereon and through an aperture in a vertical locking bar. The locking bar is secured to the corresponding upright by a padlock at the top of the bar.

A major problem associated with prior art gun racks is the difficulty in securing the guns against theft and removal by unauthorized persons. A padlock, such as that used in the aforementioned U.S. Pat. No. 4,139,100, can be easily cut by a thief or other intruder. Furthermore, the entire rack is usually removable by simply detaching the mounting screws from the wall on which the rack is mounted. There is therefore a need for a gun rack with improved security features for securing the gun stored in the rack against theft and unauthorized removal.

DISCLOSURE OF THE INVENTION

According to the present invention, a gun rack includes a frame having gun barrel support means and gun trigger guard receiving means projecting from the frame for supporting a gun in a substantially horizonal position. Mounting means is provided for mounting the frame with a vertical support surface, such as a wall. The gun rack further includes first securing means projecting from the frame and second securing means engageable with the first securing means in locking engagement, to inhibit removal of the gun from the rack.

In accordance with a unique feature of the invention, the first securing means includes a hollow member having first and second holes in respective opposed sides thereof. The second securing means includes an elongated bar and a lug projecting therefrom. The lug has third and fourth holes in respective opposed sides thereof and is telescopically receivable within the hollow member, to align the respective first, second, third and fourth holes in transverse axial alignment for receiving a hasp of a locking device, whereby the first and second securing means are secured together in locking engagement.

In one embodiment, the hollow member has first and second pairs of holes in the respective opposed sides thereof and the lug has third and fourth pairs of holes in the respective opposed sides thereof. When the lug is telescopically received within the hollow member, the respective holes of the third and fourth pairs are aligned in transverse axial alignment with the respective holes of the first and second pairs, for receiving a substantially U-shaped hasp of a locking device, whereby the lug is secured in locking engagement with the hollow member. In another embodiment, the opposed sides of the hollow member have respective first and second recesses. The first pair of holes is located in the first recess and the second pair of holes is located in the second recess. The first recess is adapted to receive at least a portion of the hasp and the second recess is adapted to receive at least a portion of a key-operable lock.

In accordance with another unique feature of the invention, the second securing means further includes an elongated beam mounted against the bar. The beam has a channel positionable in facing relationship with the frame for receiving at least a portion of the trigger guard receiving means when the bar is positioned with the lug telescopically received within the hollow member. In one embodiment, the second securing means includes first and second elongated bars and first and second elongated beams mounted against the respective first and second bars. The first beam has a first channel positionable in facing relationship with the frame for receiving at least a portion of the gun barrel support means. The second beam has an elongated second channel positionable in facing relationship with the frame for receiving at least a portion of the trigger guard receiving means.

In accordance with yet another feature of the invention, a panel member is mountable with the frame to substantially cover the frame and inhibit access to the mounting means mounting the frame with the vertical support surface. The panel member has respective openings to accommodate the passage of the gun barrel support means, the trigger guard receiving means and the first securing means through the panel member when the panel member is mounted with the frame. The locking engagement between the first and second securing means retains the panel member mounted with the frame. When the panel member is mounted with the frame, access to the mounting means is inhibited, so that the frame cannot be readily removed from the vertical mounting surface.

In the preferred embodiment, the frame is a substantially rectangular frame having first and second laterally spaced uprights and a plurality of vertically spaced crossbars spanning between the uprights. The gun barrel support means is comprised of a plurality of first support pins vertically spaced along the first upright. The trigger guard receiving mean is preferably comprised of a plurality of second support pins vertically spaced along the second upright. Each of the first support pins is adapted to cooperate with one of the second support pins, which is laterally spaced from the corresponding first support pin, for supporting a gun in a substantially horizontal position.

Each of the crossbars has at least one aperture extending therethrough. A plurality of mounting members are provided for extending through the respective apertures in the crossbars for securing the frame to the vertical mounting surface. The preferred embodiment of the gun rack further includes first, second, third and fourth hollow members adjacent the respective four corners of the rectangular frame. The first hollow member has first and second pairs of holes in respective opposed sides thereof, the second hollow member has third and fourth pairs of holes in respective opposed sides thereof, the third hollow member has fifth and sixth pairs of holes in respective opposed sides thereof and the fourth hollow member has seventh and eighth holes in respective opposed sides thereof.

A panel member is mountable with the frame to substantially cover the frame and inhibit access to the mounting members, so that the frame cannot be readily removed from the vertical mounting surface without first removing the panel member. The panel member has respective openings to accommodate the passage of the first, second, third and fourth hollow members, the first support pins and the second support pins through the panel member when the panel member is mounted with the frame.

The gun rack preferably further includes first and second elongated bars, each having a pair of lugs projecting therefrom adjacent respective opposed ends of the corresponding bar. Each lug has a pair of holes in respective opposed sides thereof. The four lugs are telescopically receivable within the respective first, second, third and fourth hollow members, to align the respective holes of the four lugs with the respective holes of the first, second, third and fourth hollow members in transverse axial alignment, for receiving respective first, second, third and fourth substantially U-shaped hasps of first, second, third and fourth locking devices, whereby the four lugs are secured in locking engagement with the respective first, second, third and fourth hollow members. The gun rack further includes elongated first and second beams mounted against the respective first and second bars. The first beam has a elongated first channel positionable in facing relationship with the frame for receiving respective portions of the first support pins. The second beam has an elongated second channel positionable in facing relationship with the frame for receiving respective portions of the second support pins.

BRIEF DESCRIPTION OF THE DRAWINGS

FIG.'s 5 and 6 are detailed perspective views, illustrating the locking mechanism used to secure guns mounted on the rack against theft and unauthorized removal.

DETAILED DESCRIPTION OF THE PREFERRED EMBODIMENT

Figure 1:
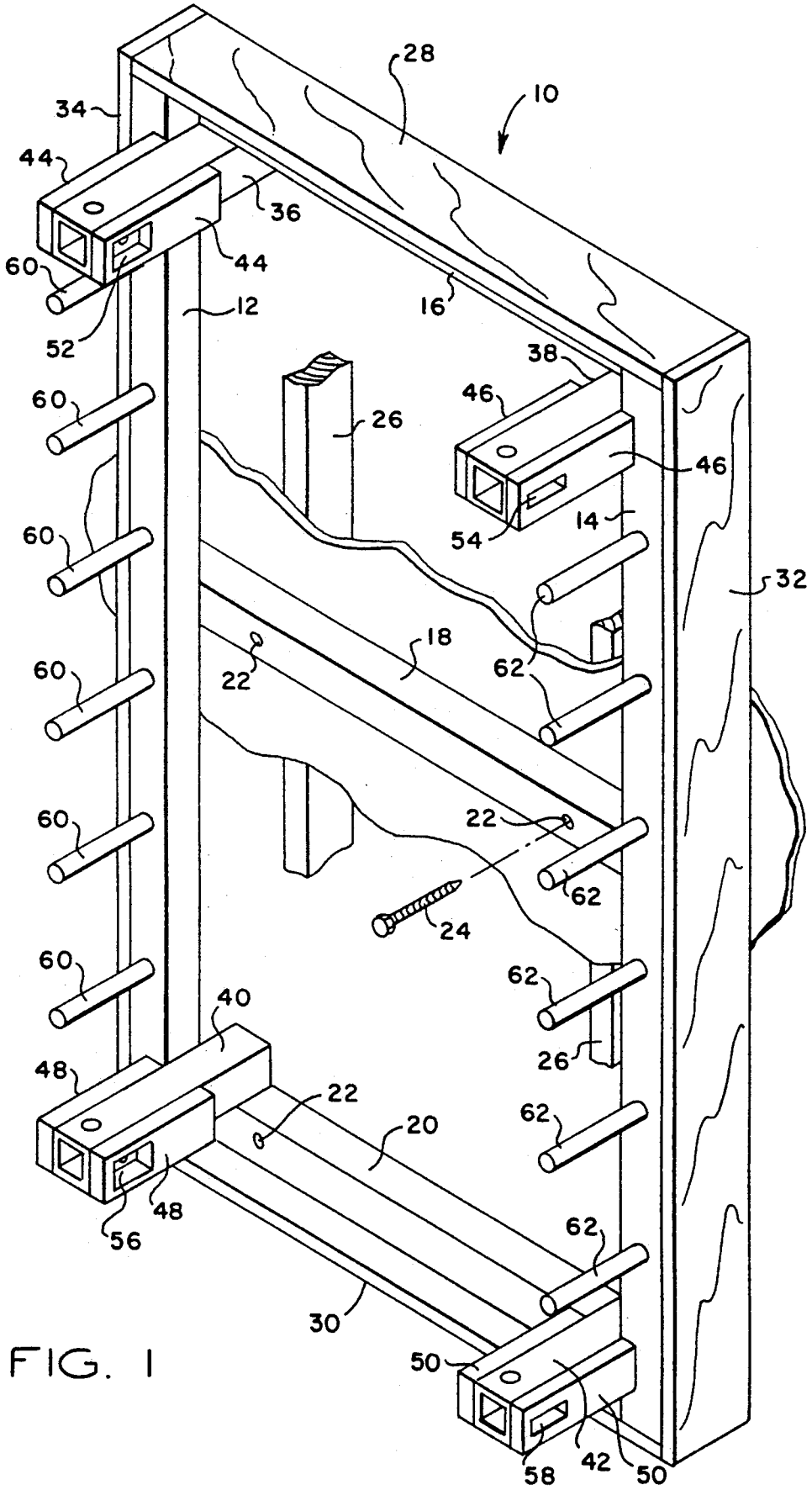
FIG. 1 is a perspective view of a frame portion of a gun rack, according to the present invention.

In the description which follows, like parts are marked throughout the specification and drawings with the same respective reference numerals. The drawings are not necessarily to scale and in some instances proportions may have been exaggerated in order to more clearly depict certain features of the invention.

Referring to FIG. 1, a rack for storing firearms includes a substantially rectangular frame 10, which is comprised of a pair of laterally spaced uprights 12 and 14 and three vertically spaced crossbars 16, 18 and 20 spanning between uprights 12 and 14. Each crossbar 16, 18 and 20 has a plurality of apertures 22, each of which is adapted to receive a threaded bolt 24 (one of which is shown in FIG. 1). Bolts 24 are adapted to penetrate into respective wall studs 26, to fasten frame 10 to a vertical mounting surface, such as a wall. Uprights 12 and 14 and crossbars 16, 18 and 20 are preferably made of a square stock steel material. Respective plywood facings define top, bottom and opposed side panels 28, 30, 32 and 34, respectively, of frame 10. Upright 12 has a plurality of vertically spaced metal support pins 60 projecting outwardly therefrom. Similarly, upright 14 has a plurality of vertically spaced metal support pins 62 projecting outwardly therefrom.

Four hollow members 36, 38, 40 and 42 are located adjacent respective four corners of rectangular frame 10. Hollow members 36 and 38 are preferably attached by welding to crossbar 16 and hollow members 40 and 42 are preferably attached by welding to crossbar 20. Hollow members 36, 38, 40 and 42 are also preferably made of square stock stainless steel material. Hollow members 36, 38, 40 and 42 have respective pairs of metal blocks 44, 46, 48 and 50 mounted on respective opposed sides of the respective hollow members 36, 38, 40 and 42. Blocks 44, 46, 48 and 50 are preferably made of stainless steel material. Blocks 44, 46, 48 and 50 have respective openings. The openings in blocks 44 define respective opposed recesses 52 on the sides of hollow member 36. The openings in blocks 46 define respective opposed recesses 54 on the sides of hollow member 38. The openings in blocks 48 define respective opposed recesses 56 on the sides of hollow member 40. The openings in blocks 50 define respective opposed recesses 58 on the sides of hollow member 42. The function of recesses 52, 54, 56 and 58 will be described in greater detail hereinafter. Blocks 44, 46, 48 and 50 are also preferably made of stainless steel material.

Figure 2:
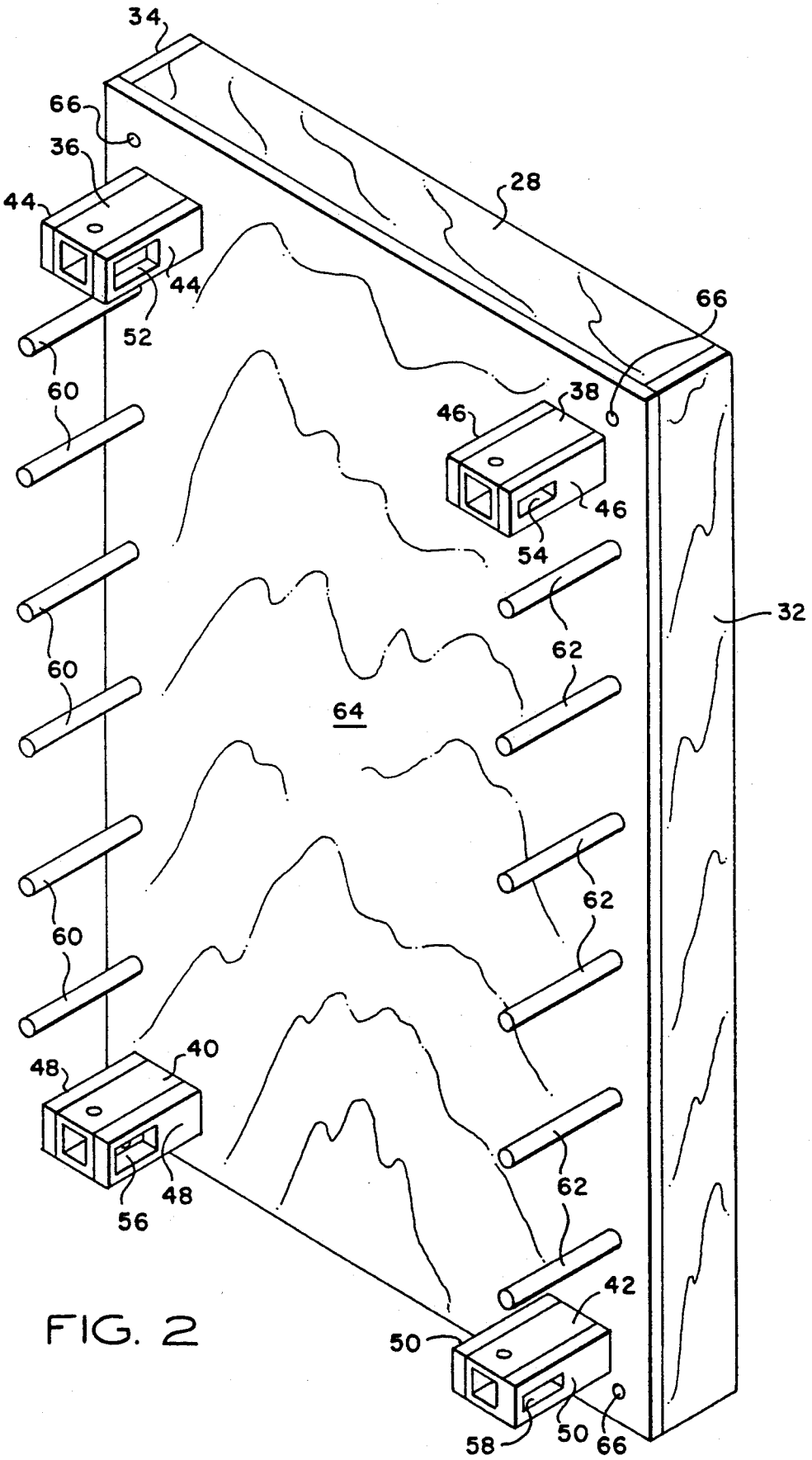
FIG. 2 is a perspective view of the gun rack of FIG. 1, with a panel member attached to the frame portion.

Referring also to FIG. 2, a relatively flat, rectangular plywood panel member 64 is attached, preferably by mounting screws 66, to the wood panels of frame 10, such that panel member 64 cooperates with wood panels 28, 30, 32 and 34 to substantially cover uprights 12 and 14 and crossbars 16, 18 and 20. When panel member 64 is secured to frame 10, as shown in FIG. 2, access to mounting bolts 24 is substantially inhibited, so that one cannot detach frame 10 from the wall on which it is mounted without first removing panel member 64 from frame 10. Panel member 64 has openings to accommodate the passage of hollow members 36, 38, 40 and 42, and support pins 60 and 62 therethrough.

Figure 3:
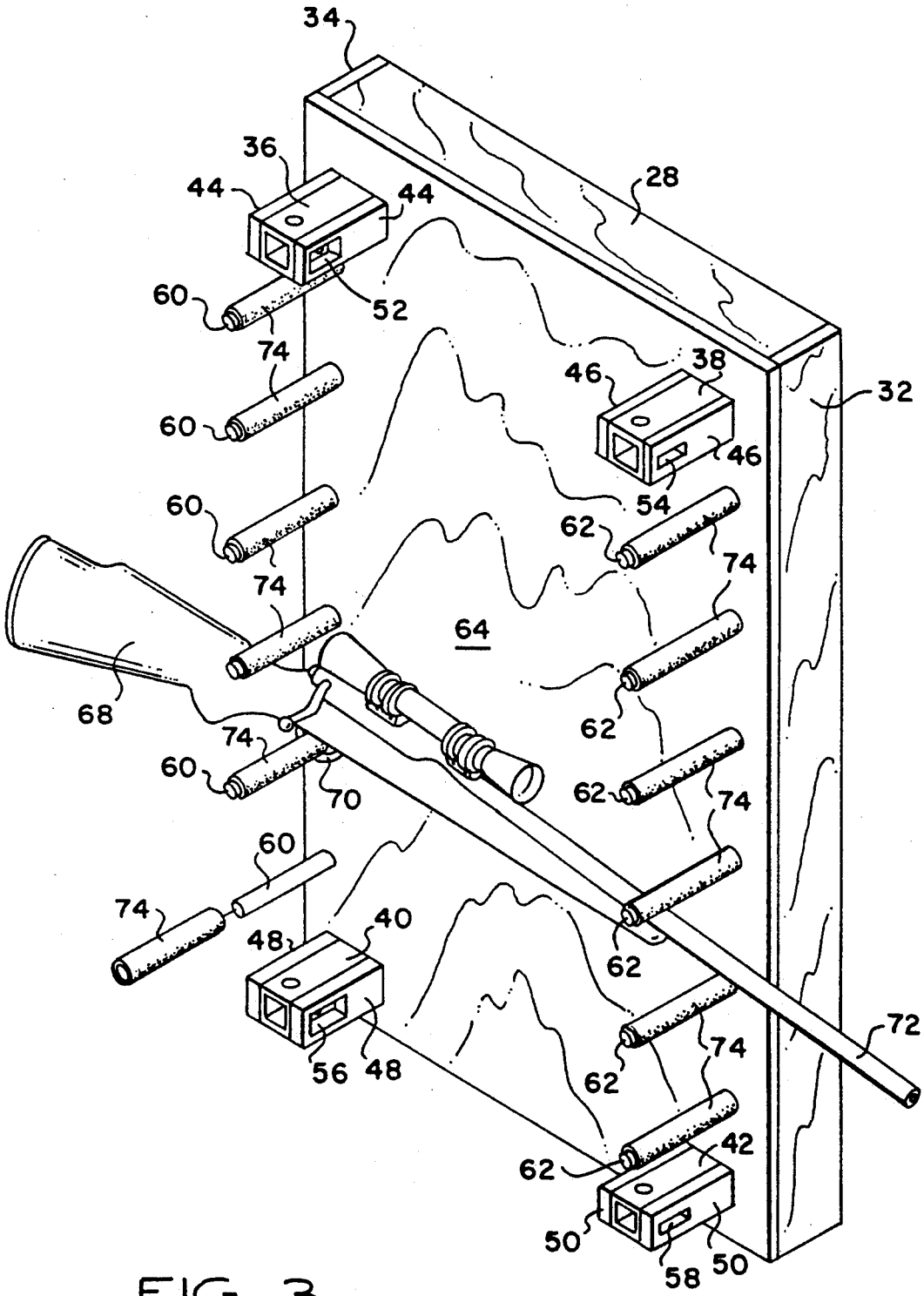
FIG. 3 is a perspective view of the gun rack of FIG. 2, showing a gun mounted on the rack.

Referring also to FIG. 3, each support pin 60 is adapted to cooperate with a support pin 62 which is laterally disposed with respect to the corresponding support pin 60, for supporting a gun, such as the rifle 68 shown in FIG. 3, in a substantially horizontal position. One of the cooperating pair of pins 60, 62 is adapted to extend through the trigger guard 70 of rifle 68, while the other pin 60, 62 is adapted to support the barrel 72 of rifle 68. In FIG. 3, one of the support pins 60 extends through trigger guard 70, while one of the support pins 62 supports barrel 72. One skilled in the art will appreciate, however, that rifle 68 can be rotated 180°, such that support pin 62 would extend through trigger guard 70 and support pin 60 would support barrel 72. To prevent damage from metal to metal contact, each support pin 60, 62 preferably includes a rubber sleeve 74 positioned in concentric relationship about the corresponding pin 60, 62.

Figure 4:
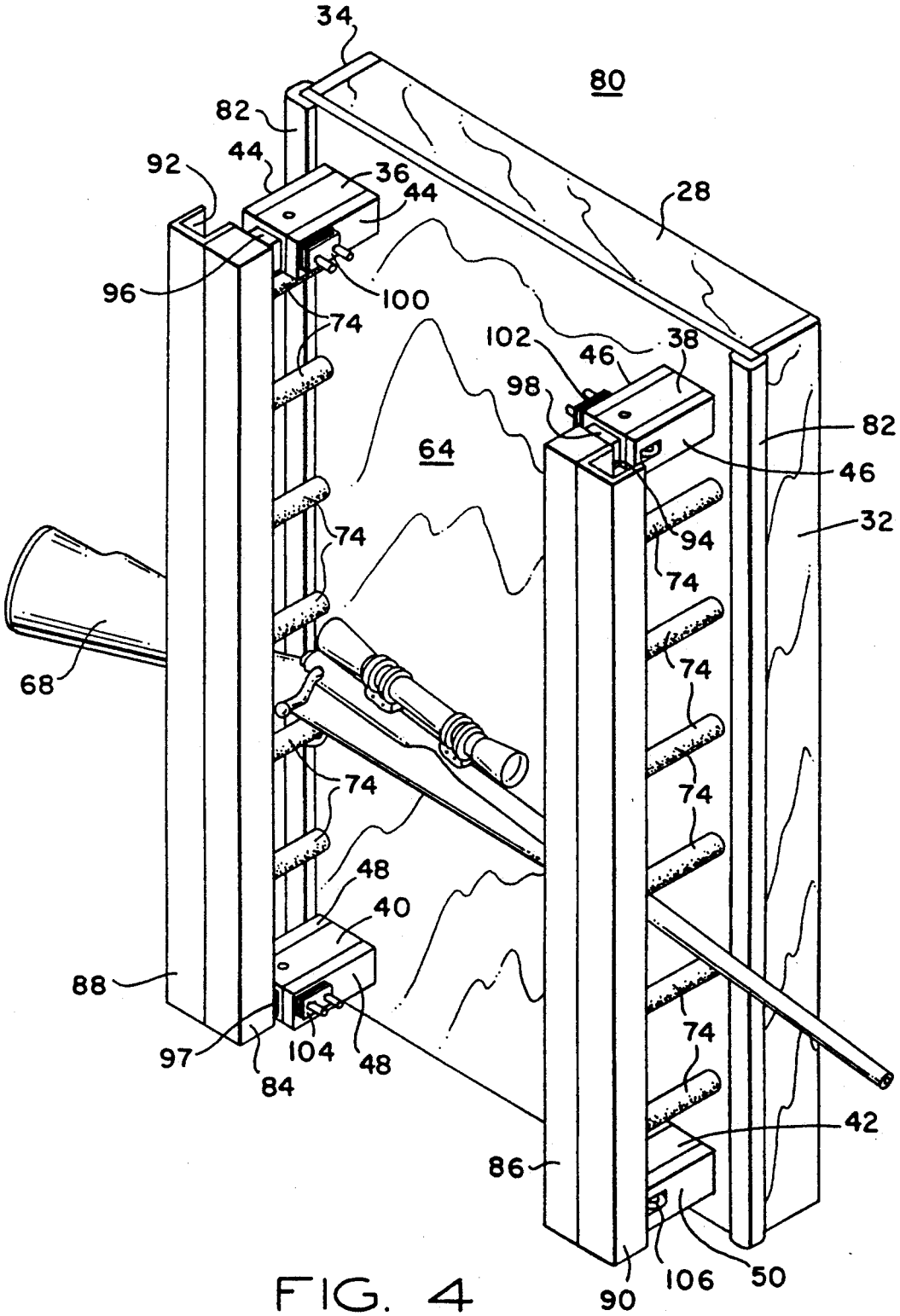
FIG. 4 is a perspective view of the fully assembled gun rack, showing a gun mounted on the rack.

Referring now to FIG. 4, a gun rack 80, according to the present invention, is shown fully assembled and in a locked condition for securing rifle 68 within the rack 80. Elongated wooden strips 82 are provided for covering the abutting edges of front panel member 64 and the respective wooden side panels 32 and 34. Two elongated locking bars 84 and 86, which are also preferably made of a square stock stainless steel material, are provided for securing gun 68 within rack 80. Elongated beams 88 and 90 are mounted against the respective bars 84 and 86. Beams 88 and 90 are preferably made of stainless steel material. Beam 88 extends substantially the entire length of bar 84 and beam 90 extends substantially the entire length of bar 86. Beam 88 has an elongated substantially U-shaped channel 92, which is positionable in facing relationship with front panel member 64. Similarly, beam 90 has an elongated, substantially U-shaped channel 94, which is also positionable in facing relationship with front panel member 64, as shown in FIG. 4.

Each bar 84, 86 has a lug projecting therefrom adjacent each end of the corresponding bar 84, 86. In FIG. 4, lugs 96 and 97 are shown projecting from respective upper and lower ends of bar 84 and lug 98 is shown projecting from an upper end of bar 86. The bottom lug of bar 86 is not visible in FIG. 4. In FIG. 4, the four lugs are telescopically received within the respective hollow members 36, 38, 40 and 42. Lug 96 is telescopically received within hollow member 36, lug 97 is telescopically received within hollow member 40 and lug 98 is telescopically received within hollow member 38. Although not shown in FIG. 4, the lug projecting from the lower end of bar 86 is telescopically received within hollow member 42. The four lugs are secured in mating engagement with the respective hollow members 36, 38, 40 and 42 by means of respective locking devices 100, 102, 104 and 106.

Referring also to FIG.'s 5–7, the locking engagement between the respective lugs and the hollow members 36, 38, 40 and 42 is illustrated in greater detail. For purposes of illustration, the engagement between the lug 96 and hollow member 36 will be described with reference to FIG.'s 5–7. One skilled in the art will appreciate, however, that the locking engagement between the other three lugs and the respective other three hollow members 38, 40 and 42 is essentially the same.

Figure 5:
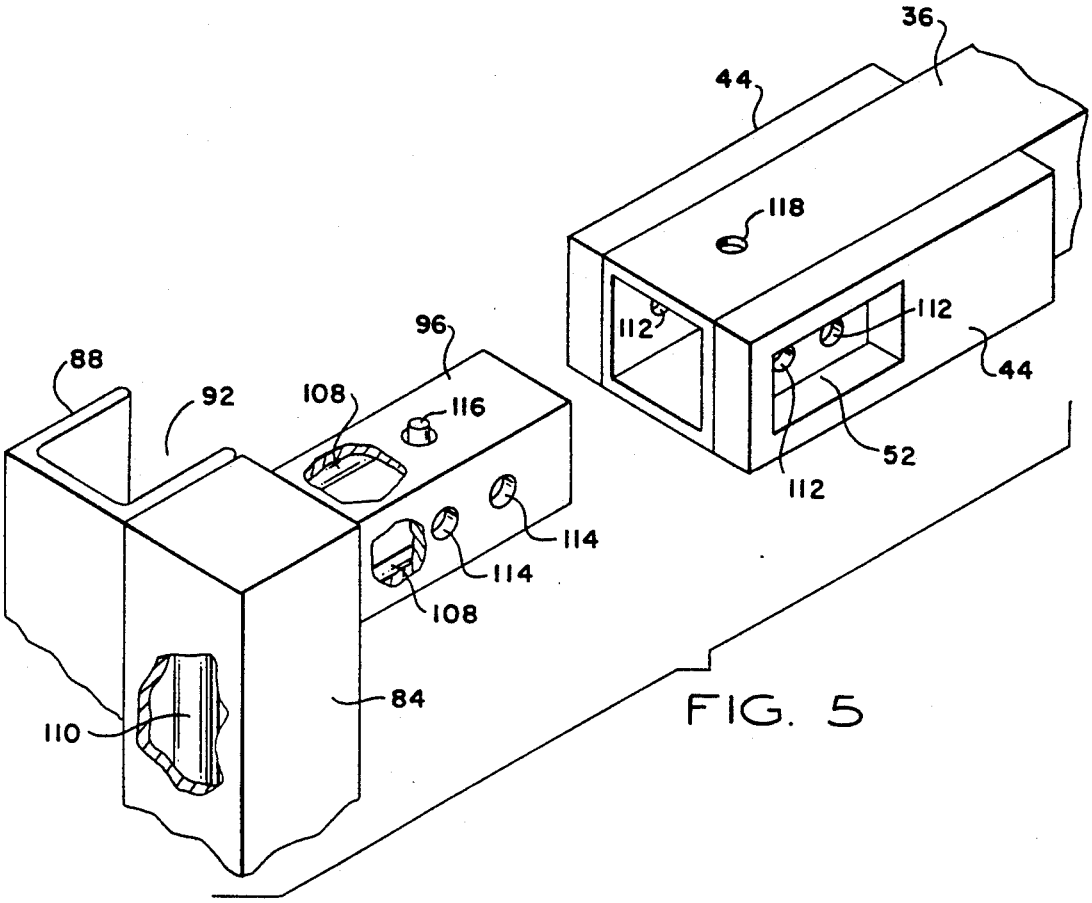

As shown in FIG. 5, lug 96 is preferably made of a square stock stainless steel material. One or more case hardened steel reinforcing shafts 108 are located in the interior of lug 96 to enhance the resistance of lug 96 to being cut. Bar 84 also preferably includes at least one reinforcing shaft 110, which extends substantially along the entire length of bar 84, for enhancing the resistance of bar 84 to being cut. Shafts 108 and 110 enhance the security of the gun rack.

Hollow member 36 has a pair of holes 112 in each side thereof, located within the corresponding recess 52. Lug 96 also has a pair of holes 114 on each side thereof. Lug 96 is telescopically receivable within hollow member 36 such that each of the holes 114 is aligned in transverse axial alignment with a corresponding hole 112.

Figure 6:
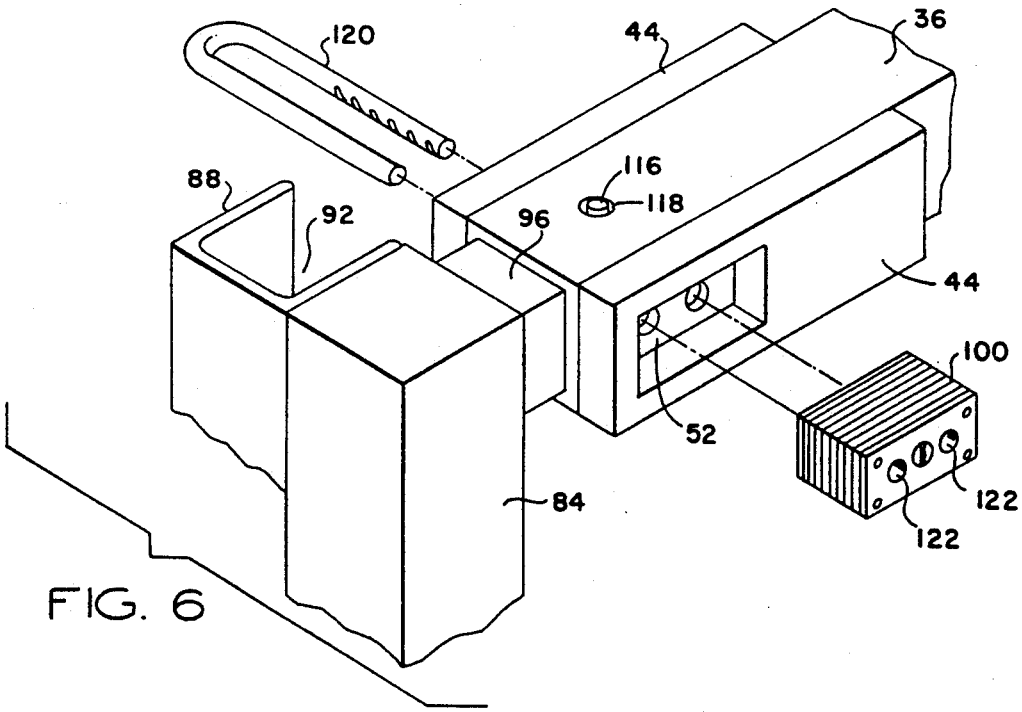

A resilient detent 116 extends through a top opening in lug 96. Detent 116 is adapted to extend through a top opening 118 in hollow member 36 when holes 114 are properly aligned with the respective holes 112, such that the mating engagement between detent 116 and top opening 118 serves to locate lug 96 longitudinally within hollow member 36. FIG. 6 shows lug 96 received within hollow member 36 and detent 116 in mating engagement with top opening 118. When lug 96 is received within hollow 36, holes 114 are aligned in transverse axial alignment with the respective holes 112, such that the aligned holes 114, 112 are adapted to receive a substantially U-shaped hasp 120 of locking device 100. Locking device 100 is preferably a key-operable lock. The arms of hasp 120 are adapted to extend through the aligned sets of openings 114 and 112 and into locking device 100, such that the arms of hasp 120 extend through rear openings 122 of locking device 100, as can be best seen in FIG. 4. When locking device 100 is locked lug 96 is secured in locking engagement with hollow member 36.

As can be best seen in FIG. 4, one of the recesses 52 is adapted to receive at least a portion of lock 100, while the other recess 52 is adapted to receive at least a portion of hasp 120. Locating portions of lock 100 and hasp 120 within the respective recesses 52 makes lock 100 less resistant to tampering.

Figure 7:
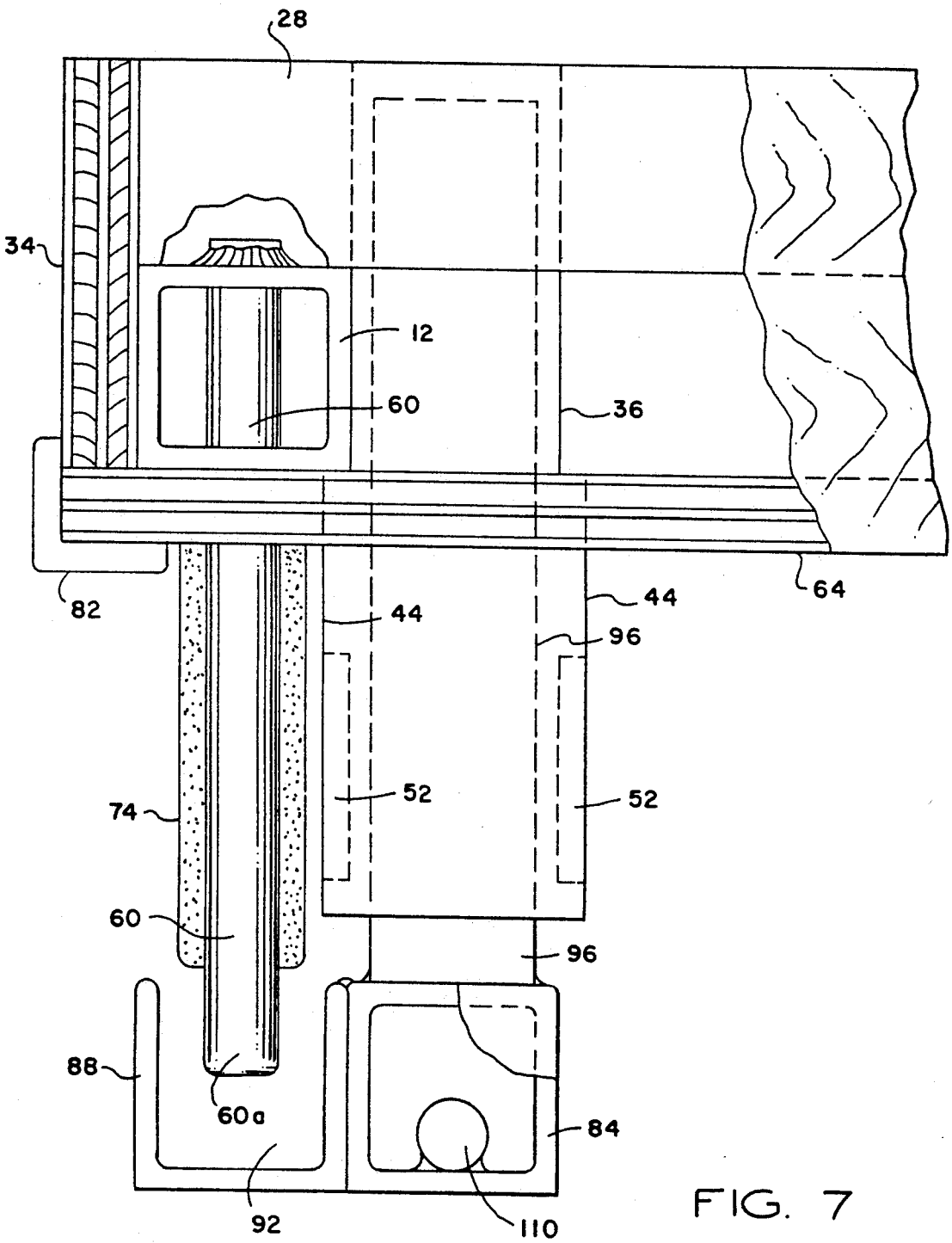
FIG. 7 is a top plan view of the locking mechanism of FIG.'s 5 and 6, with a portion thereof broken away.

Referring now to FIG. 7, when lug 96 is received within hollow member 36, as shown in FIG. 6, a distal end portion 60*a* of each support pin 60 extends into channel 92 of beam 88, to substantially inhibit access to the respective distal end portions 60*a* support pins 60. Beam 88 affectively serves as a guard to cover the respective ends of support pins 60, to prevent the guns mounted on the rack from being removed from the rack by sliding the guns off the ends of the pins 60. When lug 96 is received within hollow member 36, lug 97 is also received within hollow member 40. Similarly, as shown in FIG. 4, when lug 98 is in mating engagement with hollow member 38 and the bottom lug of bar 86 is in mating engagement with hollow member 42, respective distal end portions of support pins 62 are received within channel 94 of beam 90, to substantially inhibit access to the respective distal end portions of pins 62, such that the guns stored on the rack cannot be removed therefrom by sliding the guns off the ends of support pins 62. Pins 62 are also preferably made of case hardened steel, which increase their resistance to being cut.

When gun rack 80 is fully assembled and secured, as shown in FIG. 4, a plurality of guns 68 may be mounted in substantially horizontal positions, with each gun 68 being supported by cooperating pair of support pins 60 and 62. Locking devices 100, 102, 104 and 106 secure beams 84 and 86 in a substantially vertical orientation, with the corresponding beams 88 and 90 positioned to receive the respective distal end portions of the respective support pins 60 and 62. Therefore, a gun 68 mounted on rack 80 cannot be removed therefrom by sliding gun 68 off the ends of the corresponding support pins 60 and 62 without disengaging the lugs from the respective hollow members 36, 38, 40 and 42. Disengagement cannot be readily accomplished by cutting the locking devices because substantial portions of each of the locking devices are received within the corresponding recesses on the sides of the hollow members and are therefore not readily accessible. Nor can the lugs be readily disengaged from the hollow members by cutting the respective lugs because when the lugs are received within the respective hollow members, only a small portion of each lug protrudes therefrom. Furthermore, the steel reinforcing shafts 108 (see FIG. 5) resist cutting of the lugs.

As previously mentioned, support pins 60 and 62 are functionally interchangeable, such that both sets of pins 60 and 62 are adapted to extend through the trigger guard 70 of a gun 68 and to support the barrel 72 of the gun 68. One skilled in the art will appreciate that it is the pin which extends through the trigger guard 70 which actually retains gun 68 on rack 80. Therefore, it may be advantageous to mount some of the guns stored on rack 80 with the respective gun barrels pointed to the right, as shown in FIG. 4, and others of the guns with their gun barrels pointed in the opposite direction. In this configuration, some of the guns will be retained on rack 80 by support pins 60, while others of the guns will be retained on rack 80 by support pins 62. This configuration not only makes it more difficult for an intruder to steal all of the guns, which would require removal of both locking bars 84 and 86, but also allows the rack to be used by two different owners or custodians.

For example, as shown in FIG. 4, the guns supported on rack 80 with support pins 60 extending through the respective trigger guards of the guns can be removed from rack 80 by unlocking locking devices 100 and 104, to disengage locking bar 84. The other guns, which are stored with their gun barrels in the opposite direction, with support pins 62 extending through the respective trigger guards of the guns, can be removed from rack 80 by operating locking devices 102 and 106, to disengage locking bar 86. One set of keys can be used by a person to unlock devices 100 and 104, while another set of keys can be used by another person to unlock locking devices 102 and 106.

Various embodiments of the invention have now been described in detail. Since it is obvious that many changes in and additions to the above-described preferred embodiment may be made without departing from the nature, spirit and scope of the invention, the invention is not to be limited to said details, except as set forth in the appended claims.

What is claimed is:

1. A gun rack, comprising, in combination:

a frame having gun barrel support means and gun trigger guard receiving means projecting from said frame for supporting a gun in a substantially horizontal position;

first mounting means for mounting said frame with a vertical mounting surface;

first securing means projecting from said frame;

a panel member mountable with said frame to substantially cover said frame and inhibit access to said first mounting means, said panel member having respective openings to accommodate the passage of said gun barrel support means, said trigger guard receiving means and said first securing means through said panel member when said panel member is mounted with said frame;

second mounting means for mounting said panel member with said frame;

second securing means engageable in locking engagement with said first securing means, to retain a gun supported on said gun barrel support means and said trigger guard receiving means between said panel member and said second securing means and to retain said panel member mounted with said frame;

wherein said first securing means includes a hollow member having first and second holes on respective opposed sides of said hollow member and said second securing means includes an elongated bar having a lug projecting therefrom, said lug having third and fourth holes on respective opposed sides of said lug, said lug being telescopically receivable within said hollow member to align said first, second, third and fourth holes in transverse axial alignment for receiving a hasp of a locking device, to secure said lug in locking engagement with said hollow member; and wherein said second means includes an elongated beam mounted against said bar, said beam having a channel positionable in facing relationship with said frame for receiving at least a portion of said trigger guard receiving means when said lug is telescopically received within said hollow member.

2. A gun rack, comprising, in combination:

a frame having gun barrel support means and gun trigger guard receiving means projecting from said frame for supporting a gun in a substantially horizontal position;

mounting means for mounting said frame with a vertical mounting surface;

first securing means projecting from said frame, said first securing means including a hollow member having first and second holes in respective opposed sides of said hollow member;

second securing means engageable with said first securing means, said second securing means including an elongated bar and a lug projecting therefrom, said lug having third and fourth holes in respective opposed sides of said lug, said lug being telescopically receivable within said hollow member to align the respective first, second, third and fourth holes in transverse axial alignment for receiving a hasp of a locking device, to secure said lug in locking engagement with said hollow member;

wherein said hollow member has first and second pairs of holes in the respective opposed sides of said hollow member and said lug has third and fourth pairs of holes in the respective opposed sides of said lug, said lug being telescopically receivable within said hollow member to align respective holes of the third and fourth pairs with respective holes of the first and second pairs in transverse axial alignment for receiving a substantially U-shaped hasp of a locking device, to secure said lug in locking engagement with said hollow member; and wherein said hollow member has a top aperture and said lug has a detent projecting from a top surface of said lug for matingly engaging said top aperture, to locate said lug in telescoping relationship with said hollow member, with the respective openings of the third and fourth pairs in transverse axial alignment with the respective opening of the first and second pairs.

3. A gun rack, comprising, in combination:

a frame having gun barrel support means and gun trigger guard receiving means projecting from said frame for supporting a gun in a substantially horizontal position;

mounting means for mounting sad frame with a vertical mounting surface;

first securing means projecting from said frame, said first securing means including a hollow member having first and second holes in respective opposed sides of said hollow member;

second securing means engageable with said first securing means, said second securing means including an elongated bar and a lug projecting therefrom, said lug having third and fourth holes in respective opposed sides of said lug, said lug being telescopically receivable within said hollow member to align the respective first, second, third and fourth holes in transverse axial alignment for receiving a hasp of a locking device, to secure said lug in locking engagement with said hollow member;

wherein said hollow member has first and second pairs of holes in the respective opposed sides of said hollow member and said lug has third and fourth pairs of holes in the respective opposed sides of said lug, said lug being telescopically receivable within said hollow member to align respective holes of the third and fourth pairs with respective holes of the first and second pairs in transverse axial alignment for receiving a substantially U-shaped hasp of a locking device, to secure said lug in locking engagement with said hollow member; and wherein the opposed sides of said hollow member have respective first and second recesses, said first pair of holes being located in said first recess and said second pair of holes being located in said second recess, said first recess being adapted to receive at least a portion of said hasp and said second recess being adapted to receive at least a portion of a key-operable lock.

4. A gun rack, comprising, in combination:

a frame having gun barrel support means and gun trigger guard receiving means projecting from said frame for supporting a gun in a substantially horizontal position;

mounting means for mounting said frame with a vertical mounting surface;

first securing means projecting from said frame, said first securing means including a hollow member having first and second holes in respective opposed sides of said hollow member;

second securing means engageable with said first securing means, said second securing means including an elongated bar and a lug projecting therefrom, said lug having third and fourth holes in respective opposed sides of said lug, said lug being telescopically receivable within said hollow member to align the respective first, second, third and fourth holes in transverse axial alignment for receiving a hasp of a locking device, to secure said lug in locking engagement with said hollow member;

wherein said frame is substantially rectangular and said first securing means includes first, second, third and fourth hollow members adjacent respective first, second, third and fourth corners of said frame, said second securing means including first and second elongated bars, each bar having a lug projecting therefrom adjacent each end of the corresponding bar, the lugs of the first bar being telescopically receivable within the first and second hollow members and being engageable in locking engagement therewith, the lugs of the second bar being telescopically receivable within the third and fourth hollow members and being engageable in locking engagement therewith; and wherein said second securing means includes first and second elongated beams mounted against the respective first and second bars, said first beam having a first channel positionable in facing relationship with said frame for receiving at least a portion of said trigger guard receiving means when the lugs of the first bar are telescopically received within the respective first and second hollow members, the second beam having a second channel positionable in facing relationship with said frame for receiving at least a portion of said gun barrel support means when the lugs of the second bar are telescopically received within the respective third and fourth hollow members.

5. A gun rack, comprising, in combination:

a frame having gun barrel support means and gun trigger guard receiving means projecting from said frame for supporting a gun in a substantially horizontal position;

mounting means for mounting said frame with a vertical mounting surface;

first securing means projecting from said frame, said first securing means including a hollow member having first and second holes in respective opposed sides of said hollow member;

second securing means engageable with said first securing means, said second securing means including an elongated bar and a lug projecting therefrom, said lug having third and fourth holes in respective opposed sides of said lug, said lug being telescopically receivable within said hollow member to align the respective first, second, third and fourth holes in transverse axial alignment for receiving a hasp of a locking device, to secure said lug in locking engagement with said hollow member; and wherein said second securing means includes an elongated beam mounted against said bar, said beam having a channel positionable in facing relationship with said frame for receiving at least a portion of said trigger guard receiving means when said bar is positioned with the lug telescopically received within said hollow member.

6. A gun rack, comprising, in combination:

a frame having an gun barrel support means and gun trigger guard receiving means projecting from said frame for supporting an gun in a substantially horizontal position;

mounting means for mounting said frame with a vertical mounting surface;

first securing means projecting from said frame, said first securing means including a hollow member having first and second holes in respective opposed sides of said hollow member;

second securing means engageable with said first securing means, said second securing means including an elongated bar and a lug projecting therefrom, said lug having third and fourth holes in respective opposed sides of said lug, said lug being telescopically receivable within said hollow member to align the respective first, second, third and fourth holes in transverse axial alignment for receiving a hasp of a locking device, to secure said lug in locking engagement with said hollow member; and further including a first reinforcing shaft inside said hollow member, to strengthen said hollow member, said bar having a hollow interior, said gun rack further including a second reinforcing shaft in said hollow interior, to strengthen said bar.

7. A gun rack, comprising, in combination:

a frame having gun barrel support means and gun trigger guard receiving means projecting from said frame for supporting a gun in a substantially horizontal position;

mounting means for mounting said frame with a vertical mounting surface;

first securing means projecting from said frame, said first securing means including a hollow member having first and second holes in respective opposed sides of said hollow member;

second securing means engageable with said first securing means, said second securing means including an elongated bar and a lug projecting therefrom, said lug having third and fourth holes in respective opposed sides of said lug, said lug being telescopically receivable within said hollow member to align the respective first, second, third and fourth holes in transverse axial alignment for receiving a hasp of a locking device, to secure said lug in locking engagement with said hollow member; and wherein said frame includes first and second laterally spaced uprights, said gun barrel support means including a plurality of first support pins vertically spaced along the first upright, said trigger guard receiving means including a plurality of second support pins vertically spaced along the second upright, each of said first support pins being adapted to cooperate with one of said second support pins, which is laterally spaced from the corresponding first support pin, for supporting a gun in a substantially horizontal position, said first securing means including first and second hollow members, each hollow member having first and second holes in respective opposed sides of the corresponding hollow member, said second securing means including first and second elongated bars, each bar having a lug projecting therefrom, each lug having third and fourth holes in respective opposed sides of the corresponding lug, said second securing means further including first and second elongated beams mounted against the respective first and second bars, the first beam having an elongated first channel positionable in facing relationship with said frame for receiving respective portions of said plurality of first support pins when said first bar is positioned with the first lug telescopically received within the first hollow member, said second beam having an elongated second channel positionable in facing relationship with said frame for receiving respective portions of said plurality of second support pins when said second bar is positioned with said second lug telescopically received within said second hollow member.

8. A gun rack, comprising, in combination:

a frame having gun barrel support means and gun trigger guard receiving means projecting from said frame for supporting a gun in a substantially horizontal position;

mounting means for mounting said frame with a vertical mounting surface;

first securing means projecting from said frame; and second securing means engageable with said first securing means, to retain a gun supported on said gun barrel support means and said trigger guard receiving means, said second securing means including an elongated bar positionable in locking engagement with said first securing means and an elongated beam mounted against said bar, said beam having a channel positionable in facing relationship with said trigger guard receiving means when said bar is in locking engagement with said first securing means.

9. The gun rack of claim 8 wherein said first securing means includes first and second securing members projecting from said frame adjacent respective opposed sides of said frame, said second securing means including first and second elongated bars engageable in locking engagement with the respective first and second securing members said second securing means further including elongated first and second beams mounted against the respective first and second bars, said first beam having a first channel positionable in facing relationship with said frame for receiving at least a portion of said gun barrel support means when said first bar is in locking engagement with said first securing member, said second beam having an elongated second channel positionable in facing relationship with said frame for receiving at least a portion of said trigger guard receiving means when said second bar is in locking engagement with second securing member.

10. The gun rack of claim 9 wherein said frame includes first and second laterally spaced uprights, said gun barrel support means including a plurality of first support pins vertically spaced along the first upright, said trigger guard receiving means including a plurality of second support pins vertically spaced along the second upright, each of said first support pins being adapted to cooperate with one of said second support pins, which is laterally spaced from the corresponding first support pin, for supporting a gun in a substantially horizontal position, said first channel being adapted to receive respective portions of said first support pins when said first bar is in locking engagement with said first securing member said second channel being adapted to receive respective portions of said second support of pins when said second bar is in locking engagement with said second securing member.

11. The gun rack of claim 9 wherein said frame is substantially rectangular, said first securing means including first, second, third and fourth hollow members adjacent respective first, second, third and fourth corners of said frame, said first bar having first and second lugs projecting therefrom adjacent respective opposed ends of the first bar, the second bar having third and fourth lugs projecting therefrom adjacent respective opposed ends of the second bar, each hollow member having first and second holes on respective opposed sides of the corresponding hollow member, each lug having third and fourth holes on respective opposed sides of the corresponding lug, said first, second, third and fourth lugs being telescopically receivable within the respective first, second, third and fourth hollow members, to align the third and fourth holes of each lug with the first and second holes of the corresponding hollow member in transverse axial alignment for receiving a hasp of a locking device, to secure each lug in locking engagement with the corresponding hollow member.

12. A gun rack, comprising, in combination:

a frame having first and second laterally spaced uprights and a plurality of vertically spaced crossbars spanning between the uprights, said frame further including a plurality of first support pins vertically spaced along the first upright and a plurality of second support pins vertically spaced along the second upright, each of said first support pins being adapted to cooperate with one of said second support pins, which is laterally spaced from the corresponding first support pin, for supporting a gun in a substantially horizontal position, each of said crossbars having at least one aperture extending therethrough;

a plurality of mounting members adapted to extend through the respective apertures in the crossbars for securing the frame to a vertical mounting surface;

first, second, third and fourth hollow members projecting from said frame, said first hollow member being vertically spaced from said second hollow member, said third hollow member being vertically spaced from said fourth hollow member, said first hollow member being laterally spaced from said third hollow member and said second hollow member being laterally spaced from said fourth hollow member, said first hollow member having first and second holes on respective opposed sides thereof, said second hollow member having third and fourth holes on respective opposed sides thereof, said third hollow member having fifth and sixth holes on respective opposed sides thereof and said fourth hollow member having seventh and eighth holes on respective opposed sides thereof;

a panel member mountable with said frame to substantially cover said frame and inhibit access to the mounting members, said panel member having respective openings to accommodate the passage of said first, second, third and fourth hollow members, said first support pins and said second support pins through said panel member when said panel member is mounted with said frame;

second mounting means for mounting said panel member with said frame;

first and second elongated bars, said first bar having first and second lugs projecting therefrom adjacent respective opposed ends of the first bar, said second bar having third and fourth lugs projecting therefrom adjacent respective opposed ends of the second bar, said first lug having ninth and tenth holes on respective opposed sides thereof, said second lug having eleventh and twelfth holes on respective opposed sides thereof, said third lug having thirteenth and fourteenth holes on respective opposed sides thereof, said fourth lug having fifteenth and sixteenth holes on respective opposed sides thereof, said first, second, third and fourth lugs being telescopically receivable within the respective first, second, third and fourth hollow members to align the holes of the first, second, third and fourth lugs with respective holes of the respective first, second, third and fourth hollow members in transverse axial alignment for receiving respective first, second, third and fourth hasps of respective first, second, third and fourth locking devices, to secure the respective first, second, third and fourth lugs in locking engagement with the respective first, second, third and fourth hollow members; and elongated first and second beams mounted against the respective first and second bars, said first beam having an elongated first channel positionable in facing relationship with said frame for receiving respective portions of the plurality of first support pins when the first and second lugs are telescopically received within the respective first and second hollow members, said second beam having an elongated second channel positionable in facing relationship with said frame for receiving respective portions of said plurality of second support pins when the third and fourth lugs are telescopically received within the respective third and fourth hollow members.

13. The gun rack of claim 12 wherein each hollow member has a pair of holes on each side thereof and each lug has a pair of apertures on each side thereof, each pair of apertures of each lug being alignable in transverse axial alignment with a corresponding pair of holes in the corresponding hollow member when the corresponding lug is telescopically received within the corresponding hollow member for receiving a substantially U-shaped hasp of a locking device to secure each lug in locking engagement with the corresponding hollow member, the opposed sides of each hollow member having respective first and second recesses, one pair of holes of each hollow member being located in the corresponding first recess and the other pair of holes of each hollow member being located in the corresponding second recess, each of the first recesses being adapted to receive at least a portion of the corresponding hasp and each of the second recesses being adapted to receive at least a portion of a key-operated lock, which is engageable in locking engagement with the corresponding hasp.

* * * * *